US006056389A

United States Patent [19]

Moon et al.

[11] Patent Number: 6,056,389

[45] Date of Patent: May 2, 2000

[54] INKJETTING DEVICE FOR AN INKJET PRINTER

[75] Inventors: Jae-ho Moon, Seoul; Chang-roul Moon, Euwang; Kyu-ho Shin, Suwon, all of Rep. of Korea

[73] Assignee: Samsung Electronics Co., Ltd., Suwon, Japan

[21] Appl. No.: 09/182,427

[22] Filed: Oct. 30, 1998

[30] Foreign Application Priority Data

Oct. 31, 1997 [KR] Rep. of Korea ..... 97/57368

[51] Int. Cl.[7] ..... B41J 2/04

[52] U.S. Cl. ..... 347/54

[58] Field of Search ..... 347/53, 55, 75, 347/54

[56] References Cited

U.S. PATENT DOCUMENTS 4,417,255 11/1983 Furukawa ..... 347/75

4,480,259 10/1984 Kruger et al. ..... 347/54

FOREIGN PATENT DOCUMENTS 2-150353 6/1990 Japan ..... 347/54

3-61544 3/1991 Japan ..... 347/54

3-133656 6/1991 Japan ..... 347/54

1767998 10/1992 Russian Federation ..... 347/54

*Primary Examiner*—John Barlow

*Assistant Examiner*—An H. Do

*Attorney, Agent, or Firm*—Staas & Halsey LLP

[57] ABSTRACT

An inkjetting device for an inkjet printer includes an ink chamber formed at a lower portion of a nozzle plate having a plurality of nozzle orifices; a barrier, having a cavity at a respectively opposite position of the nozzle orifices, formed at a bottom face of the ink chamber; and a membrane located between the ink chamber and the barrier. A ball to strike the membrane is received in the cavity and a magnetic vibrator to vibrate the ball is formed at a lower portion of the barrier.

20 Claims, 2 Drawing Sheets

INKJETTING DEVICE FOR AN INKJET PRINTER

CROSS-REFERENCE TO RELATED APPLICATIONS

This application claims the benefit of Korean Application No. 57368/1997, filed Oct. 31, 1997, in the Korean Patent Office, the disclosure of which is incorporated herein by reference.

BACKGROUND OF THE INVENTION

1. Field of the Invention

The present invention relates to an inkjetting device for an inkjet printer, and more particularly, relates to an inkjetting device for jetting ink, having a magnetic substance at an adjacent position to an ink chamber and vibrating the magnetic substance according to electromagnetic power.

2. Background of the Related Art

Generally, the techniques applied for a conventional drop and demand-type inkjet printer head are divided into a piezo type, a thermal-type, a continuously jetting type and so on. As shown in FIG. 1, the piezo-type has a piezoelectric element 1 to inject ink I and is used in the inkjet printer heads of the Epson company. As shown in FIGS. 2 and 3, the thermal-type has an exothermal body 2 which generates heat to jet the ink I and is used in the inkjet printer heads of the Hewlett-Packard Co., and the Canon Co., respectively. Additionally, as shown in FIG. 4, the continuously jetting type generates a magnetic force and an electrostatic force and is used in other inkjet printer heads.

As shown in FIG. 1, for generating a displacement, a driving signal is applied to the piezoelectric element 1 in the piezo-type inkjet printer head using the piezoelectric element 1. The ink is jetted by transmitting the displacement to the ink I.

As shown in FIGS. 2 and 3, when the driving signal passes through the exothermal body 2 via an electrode (not shown), the exothermal body 2, having a large resistance, generates heat in the thermal-type inkjet printer head using the exothermal body 2. The generated heat, which about boils the ink I, generates an air bubble in the ink I. Consequently, the generated air bubble jets the ink I from the inkjet printer head.

As shown in FIG. 4, the continuously jetting type inkjet printer head, which uses the magnetic force and the electrostatic force, has a permanent magnet 3 and a thin film coil 4 to jet the conductive ink I continuously. Accordingly, the generated magnetic force and electrostatic force generated by the driving signal change a moving direction of an ink droplet and print the ink I onto printing paper.

In the piezo-type inkjetting method, printing speed is low, the printer head cannot have a plurality of nozzles and a production yield is very low because the printer head is very expensive. Moreover, in the thermal-type inkjetting method, a life span of the printer head is poor, resolution is lowered, compatibility of the ink is bad and the structure of the printer head is complex. In the continuously jetting type inkjet method, the printer head consumes a large amount of ink and efficiency is lowered in spite of the fast printing speed.

SUMMARY OF THE INVENTION

Therefore, it is an object of the present invention to provide an inkjetting device for an inkjet printer for reducing manufacturing cost by having a simplified structure.

It is another object of the present invention to provide an inkjetting device for an inkjet printer for reducing an amount of ink which is expended by jetting ink using a vibrating force of a vibrator.

Additional objects and advantages of the invention will be set forth in part in the description which follows and, in part, will be obvious from the description, or may be learned by practice of the invention.

The foregoing objects of the present invention are achieved by providing an inkjetting device for an inkjet printer, in which an ink chamber is formed at a lower portion of a nozzle plate having a plurality of nozzle orifices; a barrier, having a cavity at a respectively opposite position of the nozzle orifices, is formed at a bottom side of the ink chamber; and a membrane is located between the ink chamber and the barrier. A ball for stroking the membrane is received in the cavity and means for vibrating the ball is formed at a lower portion of the barrier.

In an embodiment of the present invention, the ball is made of a magnetic substance and the vibrating means is a magnetic vibrator. Preferably, the barrier includes a silicon wafer and the membrane is made of silicon rubber.

The objects of the present invention will be more clearly understood through a detailed description of the preferred embodiment and the attached drawings.

BRIEF DESCRIPTION OF THE DRAWINGS

A more complete appreciation of the present invention, and many of the attendant advantages thereof, will become readily apparent as the same becomes better understood by reference to the following detailed description when considered in conjunction with the accompanying drawings in which like reference symbols indicate the same or similar components, wherein.

DETAILED DESCRIPTION OF THE PREFERRED EMBODIMENTS

Figure 1:
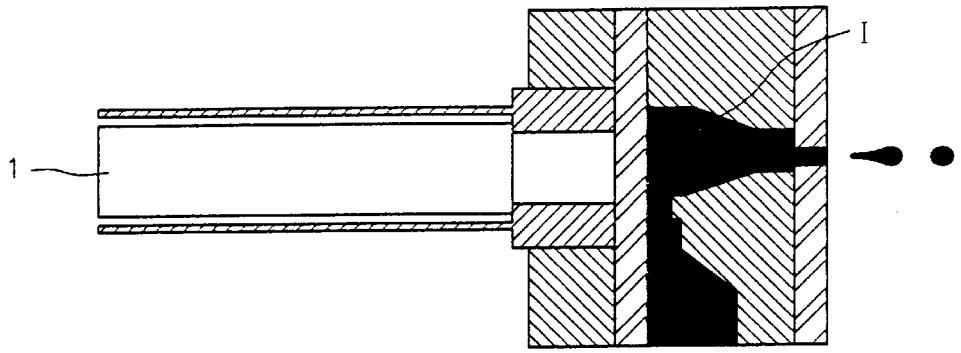
FIG. 1 (Prior Art)
FIG. 1 is a sectional view illustrating a piezo-type inkjetting device of the Epson Co.
Figure 2:
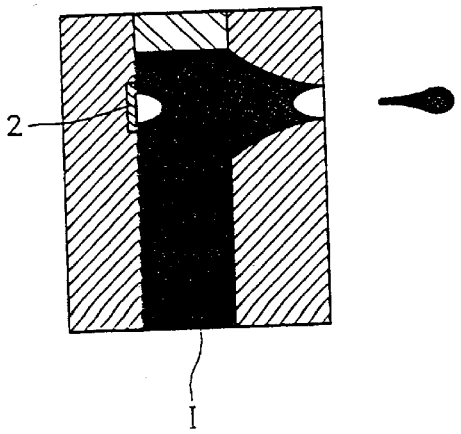
FIG. 2 (Prior Art)
FIGS. 2 and 3 are perspective views illustrating thermal-type inkjetting devices of the Hewlett-Packard Co., and the Canon Co., respectively.
Figure 3:
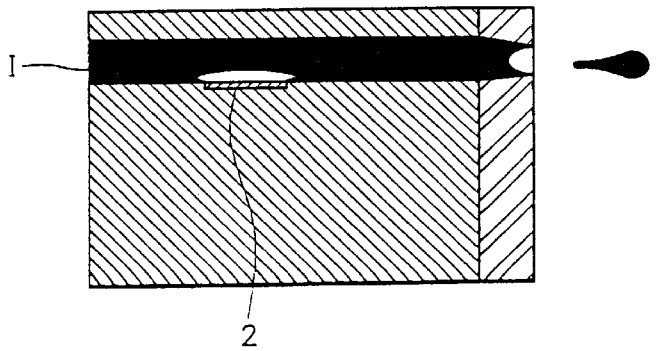
FIG. 3 (Prior Art)
Figure 4:
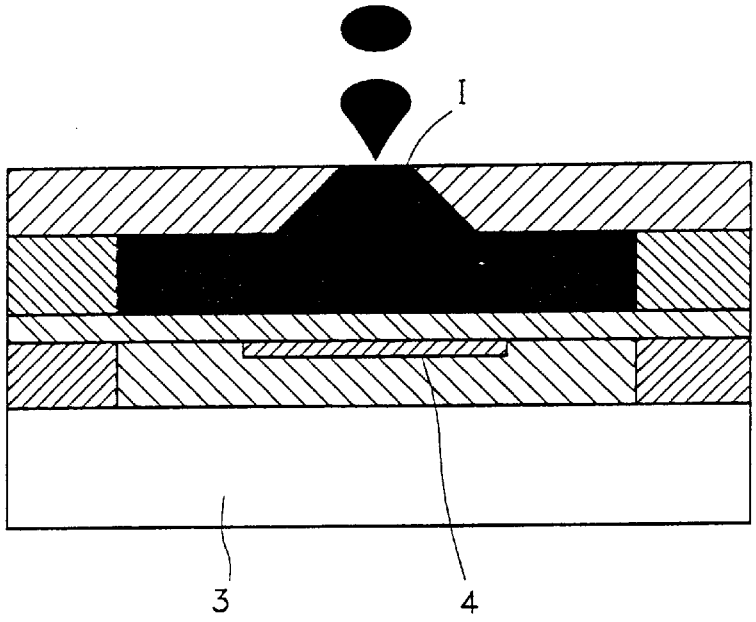
FIG. 4 (Prior Art)
FIG. 4 is a perspective view illustrating a conventional continuously inkjetting device using a magnetic force and an electrostatic force.

Reference will now made in detail to the present preferred embodiments of the present invention, examples of which are illustrated in the accompanying drawings, wherein like reference numerals refer to the like elements throughout.

The objects, characteristics and advantages of the present invention will be more clearly understood through the preferred embodiment of the present invention by referring to the attached drawings.

In the following description, when the detailed description related to the disclosed function and structure is unnecessarily obvious in explaining the embodiment of the present invention, the detailed description will be omitted.

Figure 5:
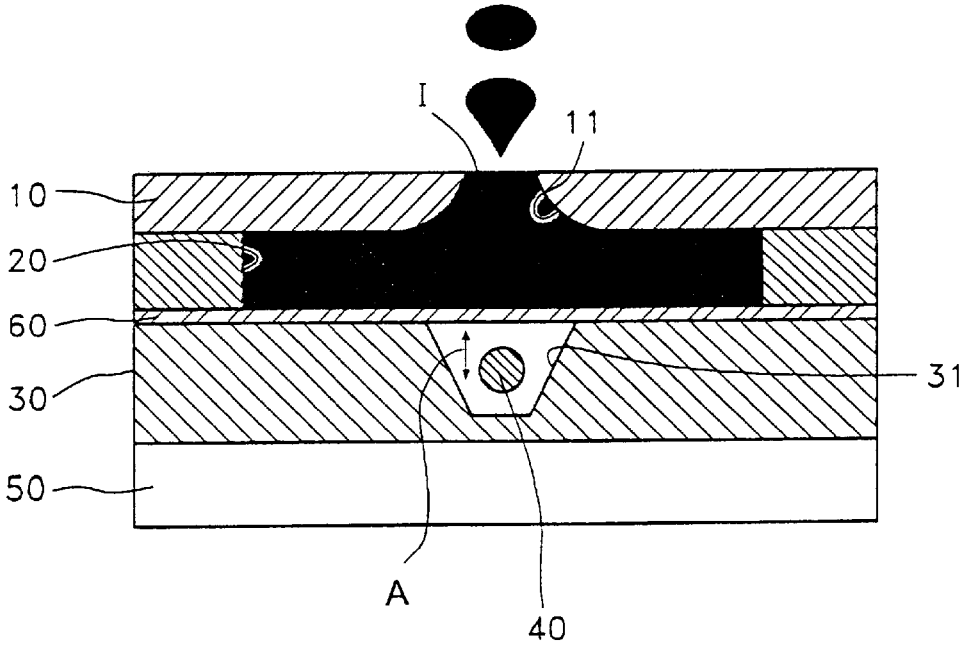
FIG. 5 is a perspective view illustrating an inkjetting method according to an embodiment of the present invention.

As shown in FIG. 5, according to the embodiment of the present invention, an ink chamber 20 is formed at a lower portion of a nozzle plate 10 having a plurality of nozzle orifices 11. A barrier 30 having a cavity 31 therein is formed at a bottom surface of the ink chamber 20, wherein the cavity 31 receives a ball 40 at a respective opposite position to the plurality of nozzle orifices 11. Therefore, each nozzle orifice 11 is opposite a respective cavity 31 and a respective ball 40. Preferably, it is possible that the barrier 30 is made of a silicon wafer. Further, the ball 40 received in the cavity 31 is made of a magnetic substance and has a very small diameter.

A magnetic vibrator 50 for providing magnetic force to the ball 40 is formed at a lower portion of the barrier 30. A flexible membrane 60 is located between the ink chamber 20 and the barrier 30 and can be made of silicon rubber.

The operation of the inkjetting device according to the embodiment of the present invention will be described hereinafter.

First, when power is applied to the magnetic vibrator 50, a magnetic field is generated in the magnetic vibrator 50 and vibrates the ball 40 received in the cavity 31 of the barrier 30 severely but minutely.

As shown by the arrow "A" in FIG. 5, the vibration of the ball 40 causes the ball 40 to collide with the flexible membrane 60 which is located on an upper portion of the barrier 30 and over the cavity 31. The flexible membrane 60, made of a soft substance (e.g., silicon rubber, as noted above), is moved upward and downward by the stroke of the ball 40 and strikes the ink chamber 20. Accordingly, the ink I in the ink chamber 20 is jetted via the nozzle orifices 11 of the nozzle plate 10.

In this manner, the ball 40 generates countless vibration in the cavity 31 of the barrier 30 due the magnetic field of the magnetic vibrator 50. The vibration is transmitted to the ink chamber 20 via the flexible membrane 60 and the ink I is jetted through the nozzle orifices 11. Accordingly, it is possible to install a plurality of nozzles having a simple structure in each printer head and reduce an amount of consumption of the ink I.

As mentioned above, the inkjetting device for the inkjet printer according to the present invention can reduce the manufacturing cost by simplifying the structure thereof. Also, the amount of the ink consumed can be reduced by converting the magnetic force of a magnet to the vibrating force of the vibrating body and transmitting the vibrating force to the ink chamber indirectly.

As the terms mentioned in the specification are determined based upon the function of the present invention, and they can be changed according to the technician's intention or a usual practice, the terms should be determined considering the overall contents of the specification of the present invention.

While there has been illustrated and described what is considered to be a preferred embodiment of the present invention, it will be understood by those skilled in the art that various changes and modifications may be made, and equivalents may be substituted for elements thereof without departing from the true scope of the present invention. In addition, many modifications may be made to adapt a particular situation to the teaching of the present invention without departing from the central scope thereof. Therefore, it is intended that the present invention not be limited to the particular embodiment disclosed as the best mode contemplated for carrying out the present invention, but that the present invention includes all embodiments falling within the scope of the appended claims.

What is claimed is:

1. An inkjetting device for an inkjet printer, comprising:

a nozzle plate having a plurality of nozzle orifices;

an ink chamber formed at a lower portion of said nozzle plate;

a barrier having a cavity formed therein and respectively opposite to said plurality of said nozzle orifices at a bottom side of said ink chamber;

a membrane formed between said ink chamber and said barrier;

a vibrating body in said cavity, to strike said membrane; and means for vibrating said vibrating body so as to strike said membrane, formed at a bottom side of said barrier:

wherein said vibrating body is not fixed to any part of said cavity or said membrane.

2. The inkjetting device according to claim 1, wherein: said vibrating body includes a magnetic substance; and said vibrating means is a magnetic vibrator.

3. The inkjetting device according to claim 1, wherein said barrier includes a silicon wafer.

4. The inkjetting device according to claim 1, wherein said membrane is made of silicon rubber.

5. The inkjetting device according to claim 1, wherein said vibrating body is ball-shaped.

6. The inkjetting device according to claim 2, wherein the magnetic vibrator generates a magnetic field in accordance with power applied thereto, said magnetic field causing said vibrating body to strike said membrane.

7. The inkjetting device according to claim 1, wherein:

said nozzle plate and said membrane form said ink chamber, and said membrane has a top surface forming the bottom side of said ink chamber;

said cavity and a top surface of said barrier contact a bottom surface of said membrane; and said vibrating means has a top surface contacting a bottom surface of said barrier.

8. The inkjetting device according to claim 2, wherein:

said nozzle plate and said membrane form said ink chamber, and said membrane has a top surface forming the bottom side of said ink chamber;

said cavity and a top surface of said barrier contact a bottom surface of said membrane; and said vibrating means having a top surface contacting a bottom surface of said barrier.

9. The inkjetting device according to claim 2, wherein said vibrating body has a smaller volume than that of said cavity.

10. The inkjetting device according to claim 5, wherein said ball-shaped vibrating body has a smaller volume than that of said cavity.

11. An inkjetting device of an inkjet printer for jetting ink, comprising:

a nozzle plate having a plurality of nozzle orifices;

a flexible membrane, together with said nozzle plate, forming an ink chamber to store the ink;

a vibrating body to selectively strike said flexible membrane according to a drive force, wherein the striking of the flexible member contracts the ink chamber and jets the ink through said nozzle orifices; and a vibrator to generate the drive force applied to said vibrating body;

wherein the vibrating body is not fixed to any part of said cavity or said flexible membrane.

12. The inkjetting device as claimed in claim 11, further comprising:

a barrier having a cavity formed in a first surface thereof, wherein the first surface of said barrier and said cavity contact a surface of said flexible membrane, and said vibrating body is maintained within said cavity by said barrier and said flexible membrane.

13. The inkjetting device as claimed in claim 12, wherein said vibrator has a surface which contacts a second surface of said barrier opposite the first surface of said barrier.

14. The inkjetting device as claimed in claim 11, wherein:

said vibrating body includes magnetic material; and said vibrator is a magnetic-type which generates a magnetic field as the drive force in response to an external power supplied thereto.

15. The inkjetting device as claimed in claim 12, wherein:

said vibrating body includes magnetic material; and said vibrator is a magnetic-type which generates a magnetic field as the drive force in response to an external power supplied to said vibrator.

16. The inkjetting device as claimed in claim 15, wherein said vibrating body is spherical.

17. The inkjetting device as claimed in claim 15, wherein said barrier includes a silicon wafer.

18. The inkjetting device as claimed in claim 12, wherein:

said cavity is formed at a first side of said ink chamber; and each nozzle orifice is formed in said nozzle plate at a second side of said ink chamber opposite to said first side of said ink chamber.

19. An inkjetting device of an inkjet printer for jetting ink, comprising:

an ink chamber to store the ink, having a flexible surface on a first side and orifices at a second side thereof;

a barrier having a cavity which contacts the flexible surface;

a movable body within said cavity, to selectively strike said flexible surface according to a drive force, wherein the striking of the flexible surface contracts the ink chamber and jets the ink through said orifices; and a drive unit positioned at a side of said barrier different from that of said cavity and spaced apart from said movable body, to generate the drive force;

wherein the vibrating body is not fixed to any part of said cavity or said flexible surface.

20. The inkjetting device as claimed in claim 19, wherein:

said movable body includes magnetic material; and said drive unit is a magnetic-type which generates a magnetic field as the drive force in response to an external power supplied to said drive unit.

* * * * *

UNITED STATES PATENT AND TRADEMARK OFFICE

CERTIFICATE OF CORRECTION

PATENT NO.: 6,056,389
DATED : May 2, 2000
INVENTOR(S): Moon, et al.

It is certified that [an/error[s]] appears in the above-identified patent and that said Letters Patent is hereby corrected as shown below:

On the title page,
Item [56], Foreign Patent Documents, change "1767998" to -- 1767338 --.

Column 4, Line 16, after "and", begin a new sentence.

Signed and Sealed this

Fifteenth Day of May, 2001

Nicholas P. Godici

*Attest:*

NICHOLAS P. GODICI

*Attesting Officer*

*Acting Director of the United States Patent and Trademark Office*